US009801464B1

(12) United States Patent
Sumners

(10) Patent No.: US 9,801,464 B1
(45) Date of Patent: Oct. 31, 2017

(54) MULTI-PANEL STORAGE COMPARTMENT FOR UPPER CABINETRY

(71) Applicant: Robert Sumners, Nunica, MI (US)

(72) Inventor: Robert Sumners, Nunica, MI (US)

( * ) Notice: Subject to any disclaimer, the term of this patent is extended or adjusted under 35 U.S.C. 154(b) by 0 days.

(21) Appl. No.: 15/224,846

(22) Filed: Aug. 1, 2016

(51) Int. Cl.
*A47B 57/00* (2006.01)
*A47B 51/00* (2006.01)
*A47B 77/04* (2006.01)

(52) U.S. Cl.
CPC ..... *A47B 51/00* (2013.01); *A47B 77/04* (2013.01)

(58) Field of Classification Search
CPC ..... A47B 51/00; A47B 77/04
USPC ..... 312/119, 122, 298, 306, 247, 312
See application file for complete search history.

(56) References Cited

U.S. PATENT DOCUMENTS 255,771 A * 4/1882 Carpenter ..... A47B 51/00 312/312
1,425,259 A * 8/1922 Howe ..... A47F 3/06 312/213
2,233,559 A * 3/1941 Shields ..... A47F 7/02 312/119
2,506,086 A * 5/1950 Jess ..... A47B 51/00 126/19 M
2,614,020 A * 10/1952 Collins ..... A47B 51/00 188/82.9
2,926,055 A * 2/1960 Mark ..... A47B 21/02 312/21
3,285,682 A * 11/1966 Nelson ..... A47B 51/00 312/247
3,443,850 A * 5/1969 Scime ..... A47B 51/00 108/147
3,950,050 A * 4/1976 Kinder ..... B66F 7/0666 108/147
4,498,714 A * 2/1985 Wiese ..... A47F 1/04 211/59.2
4,500,148 A * 2/1985 King ..... A47F 3/06 312/122
4,700,993 A * 10/1987 Fu-Long ..... A47B 17/04 312/196
5,096,275 A * 3/1992 Pappas ..... A47B 51/00 312/312
6,250,728 B1 * 6/2001 Thorp ..... A47B 51/00 292/32
6,336,692 B1 * 1/2002 Snyder ..... F24C 15/027 312/306
6,755,492 B1 * 6/2004 Hyde ..... A47B 51/00 312/247
2005/0265129 A1 * 12/2005 Agnoff ..... A47B 51/00 368/206

(Continued)

*Primary Examiner* — Hanh V Tran
(74) *Attorney, Agent, or Firm* — Price Heneveld LLP

(57) ABSTRACT

An operable cabinet storage unit includes an outer cabinet structure having a plurality of sides and an aperture for selectively accessing an interior volume. A plurality of operable cassettes are each linearly operable through the aperture to define a storage position within the interior volume and an access position outside of the interior volume. Each cassette of the plurality of cassettes includes a plurality of storage receptacles, wherein each cassette of the plurality of cassettes occupies a corresponding vertical plane within the interior volume. A retaining mechanism extends from each cassette to the outer cabinet structure, wherein the retaining mechanism selectively retains a corresponding cassette in the storage position.

15 Claims, 7 Drawing Sheets

(56) References Cited

U.S. PATENT DOCUMENTS

| | | | | |
|---|---|---|---|---|
| 2006/0066188 | A1* | 3/2006 | Crawford | E04B 9/003 312/247 |
| 2006/0238085 | A1* | 10/2006 | Greenberg | A47B 51/00 312/306 |
| 2007/0241650 | A1* | 10/2007 | Schmitt | A47B 51/00 312/312 |
| 2009/0058240 | A1* | 3/2009 | Stuwe | A47B 51/00 312/248 |

* cited by examiner

A Method 400 for installing a Multi-Cassette Storage Unit within a Cabinet Structure

MULTI-PANEL STORAGE COMPARTMENT FOR UPPER CABINETRY

FIELD OF THE INVENTION

The present invention generally relates to millwork and cabinetry, specifically, internal storage for upper cabinetry including multiple interior panels.

BACKGROUND OF THE INVENTION

Within conventional cabinetry, cabinets can be divided into upper and lower cabinet sections. Typically, these cabinets include front doors that are operable between open and closed positions for accessing the interior of these cabinets. Within various cabinets, certain portions can be difficult to reach, such that alternative storage solutions may be incorporated. These alternative storage solutions can include a lazy Susan, wire racks, and other similar space-saving solutions.

SUMMARY OF THE INVENTION

According to one aspect of the present invention, an operable cabinet storage unit includes an outer cabinet structure having a plurality of sides and an aperture for selectively accessing an interior volume. A plurality of operable cassettes are each linearly operable through the aperture to define a storage position within the interior volume and an access position outside of the interior volume. Each cassette of the plurality of cassettes includes a plurality of storage receptacles, wherein each cassette of the plurality of cassettes occupies a corresponding vertical plane within the interior volume. A retaining mechanism extends from each cassette to the outer cabinet structure, wherein the retaining mechanism selectively retains a corresponding cassette in the storage position.

According to another aspect of the present invention, an operable cabinet storage unit includes an outer cabinet structure having a plurality of sides and a front operable panel for selectively accessing an interior volume. First, second and third operable cassettes are selectively and independently positioned within the interior volume. Each of the first, second and third operable cassettes are linearly operable between a storage position within the interior volume and an access position outside of the interior volume. A retaining mechanism extends from each of the first, second and third operable cassettes to the outer cabinet structure, wherein each retaining mechanism selectively retains a corresponding cassette in the storage position.

According to another aspect of the present invention, a method for installing a multi-cassette storage unit within a cabinet structure includes providing an outer cabinet structure having a plurality of sides that define an interior volume and defining at least one cassette aperture within a portion of the outer cabinet structure, wherein the interior volume is accessible through the cassette aperture. The method also includes disposing first, second and third cassette slides on an interior surface of the outer cabinet structure, slidably disposing first, second and third operable cassettes onto the first, second and third cassette slides, respectively. Each of the first, second and third operable cassettes are linearly, selectively and separately operable along the respective first, second and third cassette slides through the at least one cassette aperture and between respective storage positions within the interior volume and respective access positions substantially outside of the interior volume. The method further includes coupling a retaining mechanism to each of the first, second and third operable cassettes and a portion of the outer cabinet structure, wherein the retaining mechanisms selectively and separately retain the first, second and third operable cassettes within the storage position and alternatively releases the first, second and third operable cassettes from the storage position.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
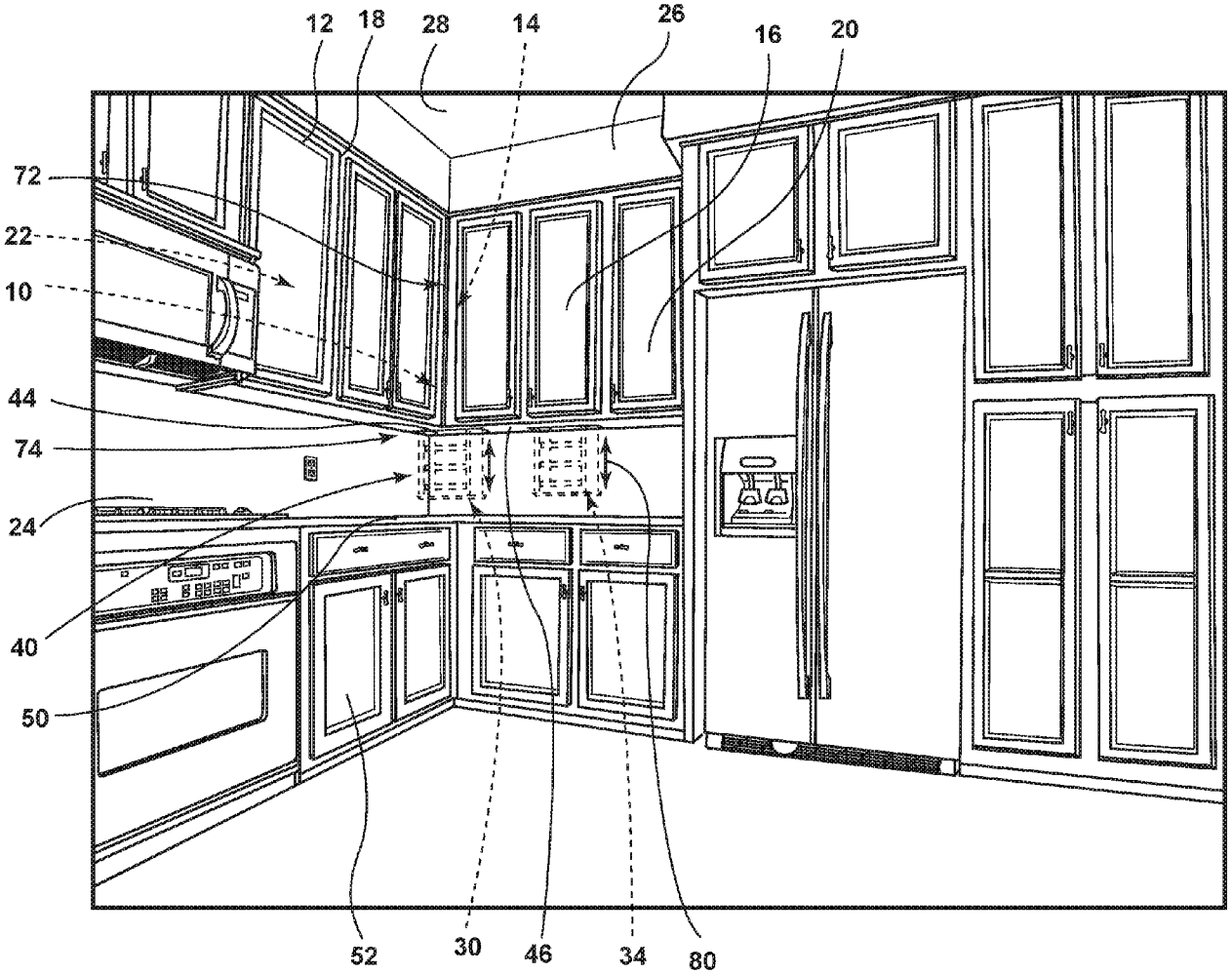
FIG. 1 is a perspective view of a kitchen setting incorporating an aspect of the multi-cassette storage module.
Figure 2:
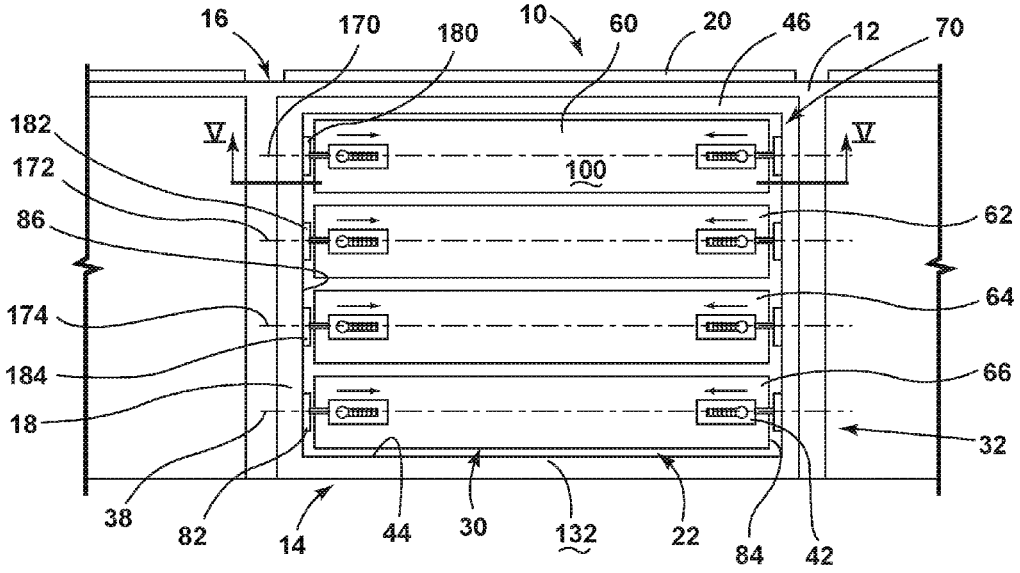
FIG. 2 is a bottom plan view of a top cabinet incorporating an aspect of the multi-cassette storage module.
Figure 3:
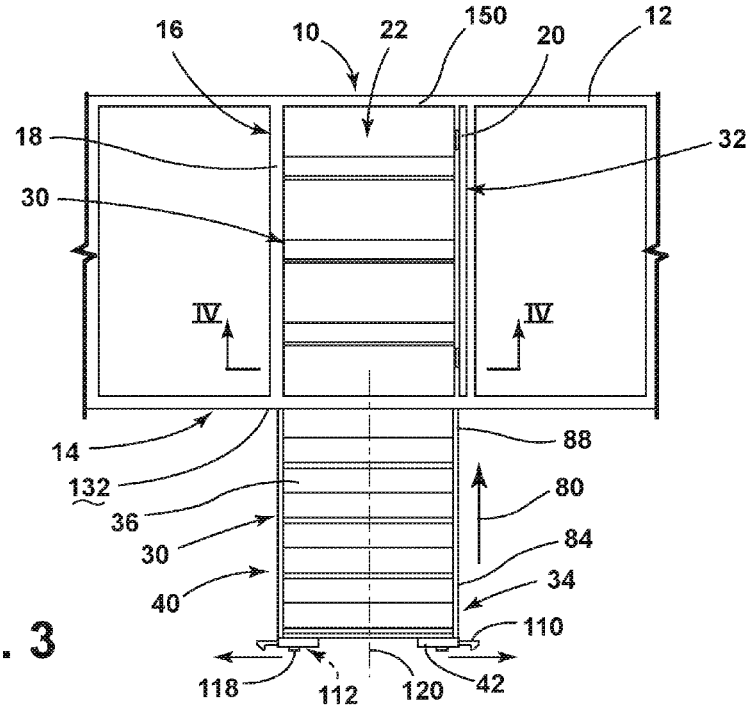
FIG. 3 is a front elevation of the top cabinet of FIG. 2.
Figure 4:
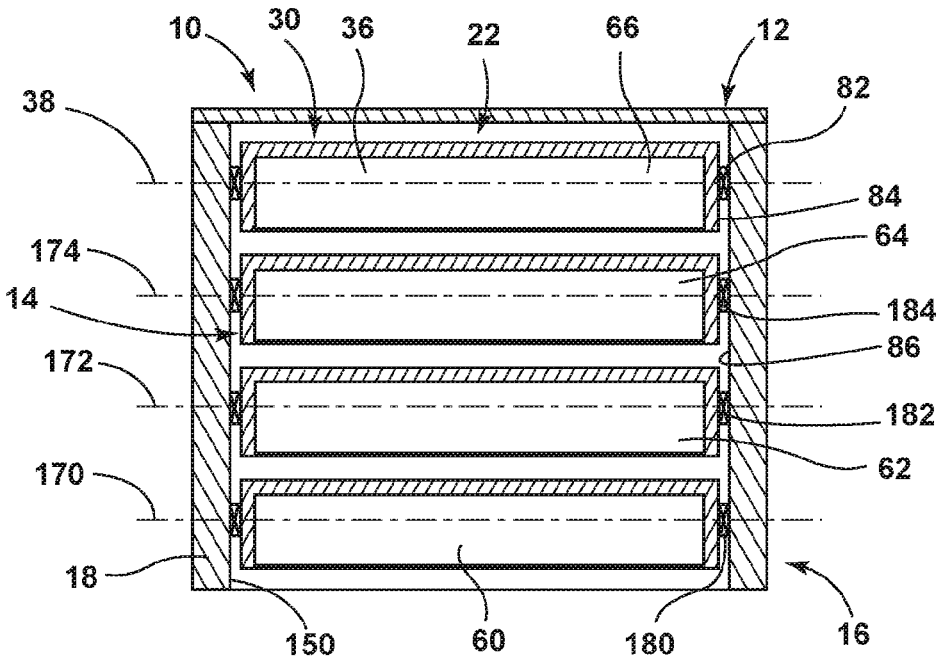
FIG. 4 is a cross-sectional view of the cabinet of FIG. 3 taken along line IV-IV.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As shown in FIGS. 1-5, reference numeral 10 generally refers to a multi-cassette storage module disposed within various cabinetry or millwork 12 that defines an operable cabinet storage unit 14. The operable cabinet storage unit 14 can include an outer cabinet structure 16 having a plurality of sides 18 and a front operable panel 20 for selectively accessing an interior volume 22 of the outer cabinet structure 16. The outer cabinet structure 16 can be mounted to a building structure such as a wall 24, bulkhead 26, ceiling 28, other cabinetry 12, or other similar structure within a residential or commercial location. A plurality of operable cassettes 30 are operably disposed within the interior volume 22 of the outer cabinet structure 16 and are each linearly operable to define a storage position 32 within the interior volume 22 and an access position 34 at least partially outside the interior volume 22. It is contemplated that each operable cassette 30 of the plurality of operable cassettes 30 includes a plurality of storage subcompartments or receptacles 36. Each operable cassette 30 of the plurality of operable cassettes 30 is adapted to occupy a corresponding vertical plane 38 or substantially vertical plane 38 within the interior volume 22 and extending to an access area 40 outside the interior volume 22 and adjacent to the cabinet structure 16. In this manner, the multi-cassette storage module 10 can include several individual operable cassettes 30 that each occupy a separate vertical plane 38 within and adjacent to the interior volume 22. It is contemplated that each of the operable cassettes 30 is operable within the respective vertical plane 38 such that each operable cassette 30 is independently and separably operable between the storage and access positions 32, 34. A retaining mechanism 42 is attached to each operable cassette 30 and extends from each operable cassette 30 to a portion of the outer cabinet structure 16. It is contemplated that the retaining mechanism 42 serves to selectively retain a corresponding operable cassette 30 within the storage position 32 and also selectively releases the corresponding operable cassette 30 from the storage position 32 for movement to the access position 34.

Referring again to FIGS. 1-5, each operable cassette 30 of the multi-cassette storage module 10 can be selectively accessed through a bottom aperture 44 defined within the outer cabinet structure 16. Accordingly, the multi-cassette storage module 10 is substantially hidden from view when each of the operable cassettes 30 is in the storage position 32. The bottom aperture 44 through which each of the operable cassettes 30 extends to define the access position 34 can be defined within a bottom wall 46 of the outer cabinet structure 16. In this manner, each of the operable cassettes 30 is vertically operable through the bottom aperture 44 and within each respective vertical plane 38 to define the storage and access positions 32, 34.

According to various alternate embodiments, it is contemplated that the aperture can be defined within a side 18 of the outer cabinet structure 16, such that each operable cassette 30 is laterally operable through the aperture within the sidewall between the storage and access positions 32, 34. In other embodiments, the aperture could be defined in a top wall 50 or countertop of a lower cabinet 52. In such an embodiment, the cassettes can be upwardly operable through the aperture to define the access position 34.

Referring again to FIGS. 1-5, it is contemplated that the multi-cassette storage module 10 can include at least first, second and third operable cassettes 60, 62, 64. The multi-cassette storage module 10 can also include a fourth operable cassette 66 or more separate operable cassettes 30 that are each slidable through respective vertical planes 38 through the bottom aperture 44 defined within the outer cabinet structure 16 to define the storage and access positions 32, 34 of each respective operable cassette 30. As exemplified in FIGS. 2 and 4, the multi-cassette storage module 10 includes four separate and distinct operable cassettes 30 that are each selectively and separably operable between the storage and access positions 32, 34 and are linearly operable through the respective vertical planes 38 between the storage and access positions 32, 34. It is contemplated that the multi-cassette storage module 10 occupies substantially all of the interior volume 22 of the upper cabinet structure 16 where the first operable cassette 60 occupies a foremost position 70 proximate the front operable panel 20 of the outer cabinet structure 16. It is contemplated that this first operable cassette 60 can be accessed either through the front operable panel 20, or through operation of the first operable cassette 60 from the storage position 32 to the access position 34. It is further contemplated that where the multi-cassette storage module 10 is incorporated, the upper cabinet structure 16 may include a front panel that is not operable, but is simply located for decorative purposes to match adjacent operable panels. It is further contemplated that the multi-cassette storage module 10 can be incorporated within a corner location 72 between two adjacent cabinets 12 that is typically a "dead space" 74 within the upper cabinet structure 16 that is difficult to reach. The incorporation of the multi-cassette storage module 10 allows this dead space 74 to be used for storage by allowing for the operability of each individual operable cassette 30 between the storage and access positions 32, 34 for storing and accessing various items within the various subcompartments 36 defined within each of the operable cassettes 30.

Referring again to FIGS. 1-5, it is contemplated that each operable cassette 30 of the plurality of operable cassettes 30 is linearly operable in a vertical direction 80 along corresponding cassette slides 82. The cassette slides 82 can be disposed along a single edge 84 of each operable cassette 30 or can be defined as opposing slides 82 that engage the vertical side edges 84 of each operable cassette 30. The cassette slides 82 can also be channels defined within the material of the outer cabinet structure 16, such as grooves that are cut within the sidewalls of the outer cabinet structure 16. Such an embodiment may be implemented where the outer cabinet structure 16 is made of wood or other similar material that is easily manipulated to define grooves or other similar sliding features within an outer cabinet structure 16. It is also contemplated that the cassette slides 82 can be separate members that are attached to an interior surface 86 of the outer cabinet structure 16 and where matching glides 88 attached to the operable cassette 30 are adapted to slidably operable within the cassette slides 82 attached to the outer cabinet structure 16. It should be understood that the material of the cassette slides 82 and cassette glides 88 can vary depending upon the needs of the user, the material of the cassettes, the material of the outer cabinet structure 16, the size of the operable cassettes 30 and the items intended to be stored within one or more of the operable cassettes 30.

It is intended that the cassette slides 82 and cassette glides 88 are adapted to slidably engage one another to allow for the placement of each operable cassette 30 completely within the outer cabinet structure 16. It is contemplated that the bottom surface 100 of each operable cassette 30, when in the storage position 32, is adapted to be flush with a bottom wall 46 of the outer cabinet structure 16 to conceal or disguise the existence of the multi-cassette storage module 10 when in the storage position 32.

According to the various embodiments, as exemplified in FIGS. 1-5, the retaining mechanism 42 for each of the operable cassettes 30 can include a laterally extending securing pin 110 that includes an outwardly biasing mechanism 112 that serves to bias the securing pin 110 in an outward direction 114 toward a corresponding retaining slot 116 defined proximate the outer cabinet structure 16. In such an embodiment, the retaining mechanism 42 can include an operable latch 118 that the user can engage to slide the securing pin 110 inward, toward a centerline 120 of the operable cassette 30, such that the securing pin 110 is separable from the retaining slot 116 to disengage the retaining mechanism 42 and operate the operable cassette 30 from the storage position 32 to the access position 34. The disengagement of the securing pin 110 with the retaining slot 116 serves to allow the operable cassette 30 to slide freely, or substantially freely, within the cassette slides 82 to define the various positions of the operable cassette 30. When the operable cassette 30 is moved back to the storage position 32, the securing pin 110 can include an angled outer edge 130 that is adapted to engage an underside 132 of the outer cabinet structure 16. The engagement of the angled outer edge 130 of the securing pin 110 with the bottom wall 46 of the cabinet structure 16 serves to inwardly bias the securing pin 110 as it passes through the aperture defined within the bottom wall 46 of the outer cabinet structure 16. Once the securing pin 110 reaches the retaining slot 116, the biasing mechanism 112, such as a spring, outwardly biases the securing pin 110 into the retaining slot 116 to engage the retaining mechanism 42 and hold the operable cassette 30 in the storage position 32.

According to the various embodiments, as exemplified in FIGS. 1-6, the sliding engagement between the operable cassette 30 and the cassette slides 82 can define various partial access positions 140 where only a portion of the subcompartments 36 may be visible below the bottom wall 46 of the outer cabinet structure 16. In such an embodiment, various detents 142 or other temporary retaining mechanisms 42 can be incorporated in the engagement between the cassette slides 82 and cassette glides 88 such that the various detents 142 can hold the operable cassette 30 in the various partial access positions 140. It is contemplated that each partial access position 140 can correspond to a separate subcompartment 36 defined within each operable cassette 30. Accordingly, where a particular operable cassette 30 includes three separate vertically positioned subcompartments 36, the two internal detents 142 can be disposed in the engagement between the cassette glide 88 and cassette slide 82 such that the operable cassette 30 can be selectively retained within a first partial access position 140 where only one of the subcompartments 36 is visible, a second partial access position 140 where two of the three subcompartments 36 are visible and the fully descended access position 34 where all three subcompartments 36 are visible and accessible by a user.

Figure 6:
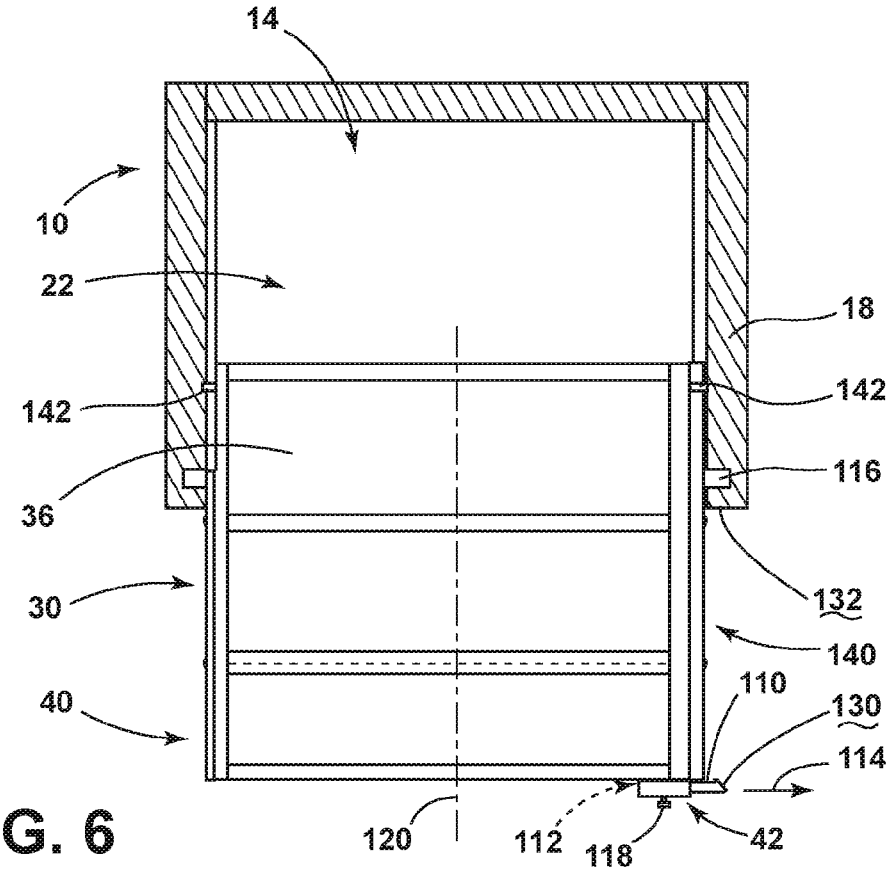
FIG. 6 is a cross-sectional view of an aspect of the multi-cassette storage module with one of the cassettes moved to the access position and exemplifying a one-part retaining mechanism.
Figure 5:
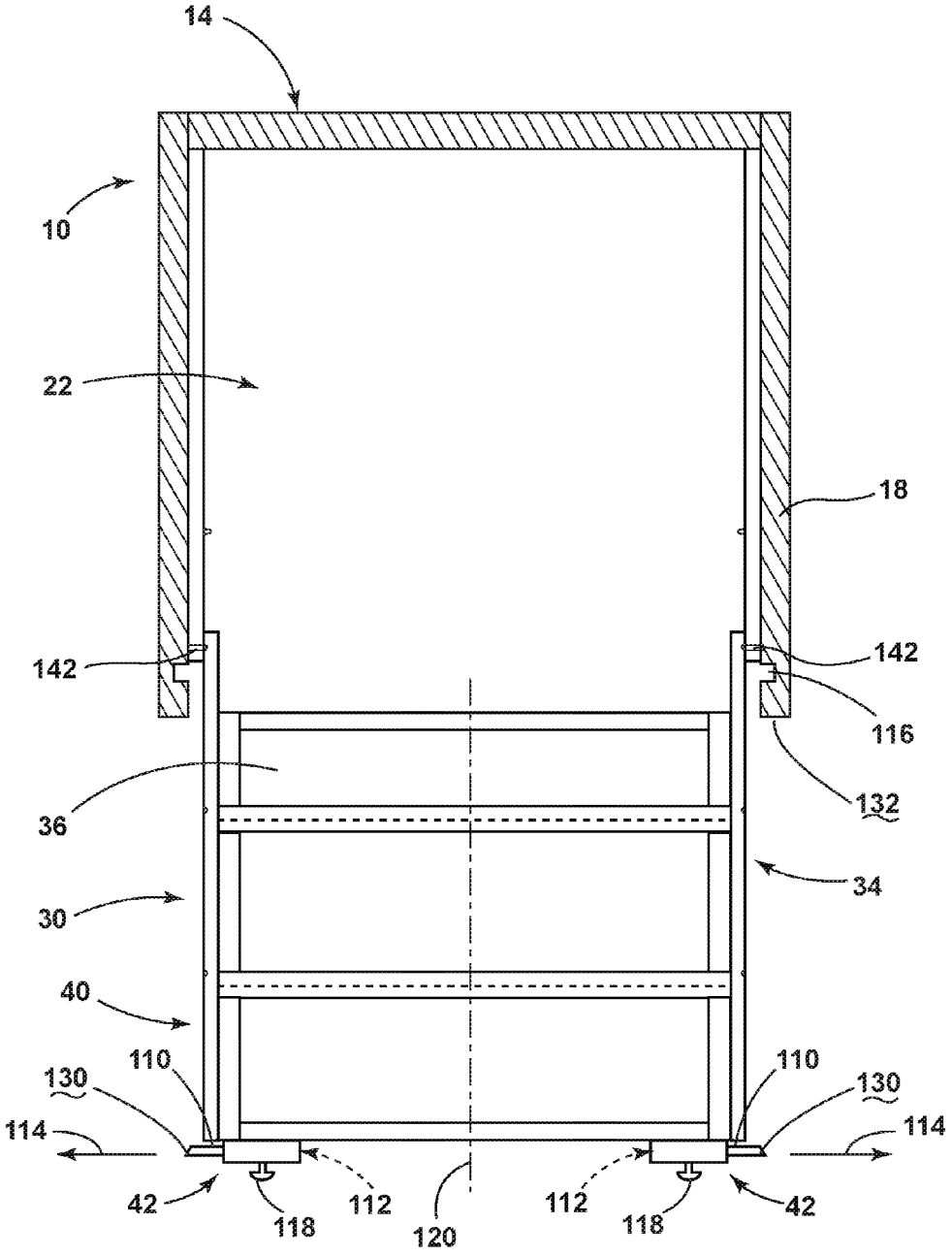
FIG. 5 is a cross-sectional view of the top cabinet of FIG. 2 taken along line V-V and illustrating one of the cassettes moved to an access position.

Referring now to FIGS. 5 and 6, it is contemplated that the retaining mechanism 42 can include one retaining pin or two opposing securing pins 110 that each include a separate biasing mechanism 112 that biases each securing pin 110 in an outward direction 114. In such an embodiment, the two outwardly biased securing pins 110 fit within corresponding retaining slots 116 disposed on each side 18 of the outer cabinet structure 16. The use of two separate securing pins 110 are necessary where greater retaining force is necessary to hold the operable cassette 30 in the storage position 32. It is contemplated that a thinner operable cassette 30 is typically designed for holding spices and other likely items and may require only one securing pin 110. A thicker operable cassette 30 for holding larger items such as condiments, fluids, and other similar items of greater weight may require two separate securing pins 110 for providing greater retaining force to secure the operable cassette 30 in the storage position 32.

Figure 7:
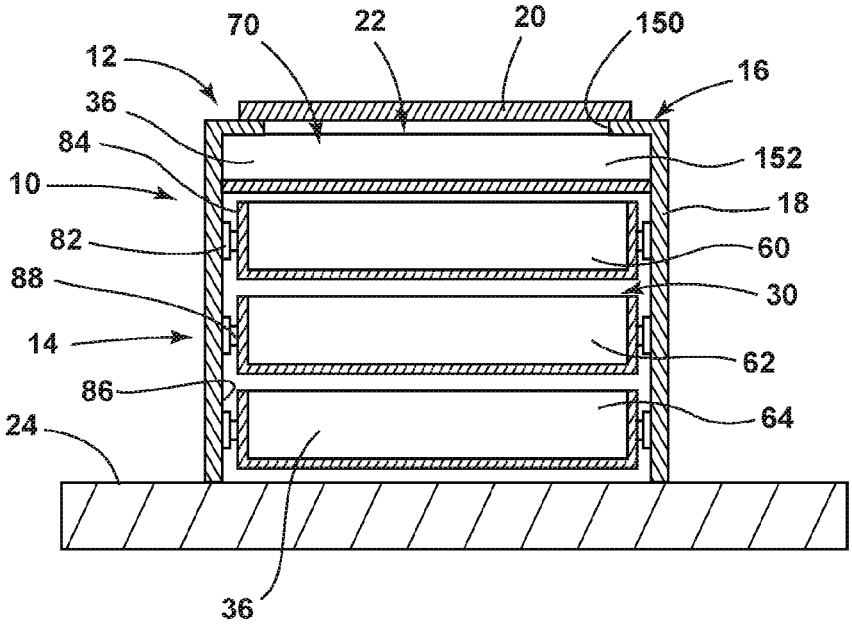
FIG. 7 is a cross-sectional view of an upper cabinet incorporating an aspect of the multi-cassette storage module incorporating a static cassette.
Figure 8:
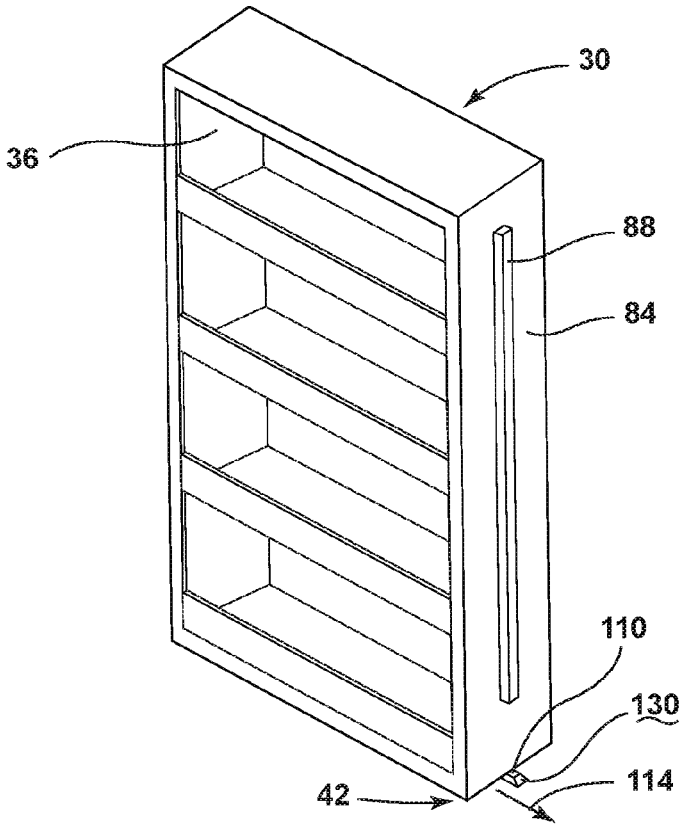
FIG. 8 is a top perspective view of an aspect of one of the operable cassettes of the multi-cassette storage module.
Figure 9:
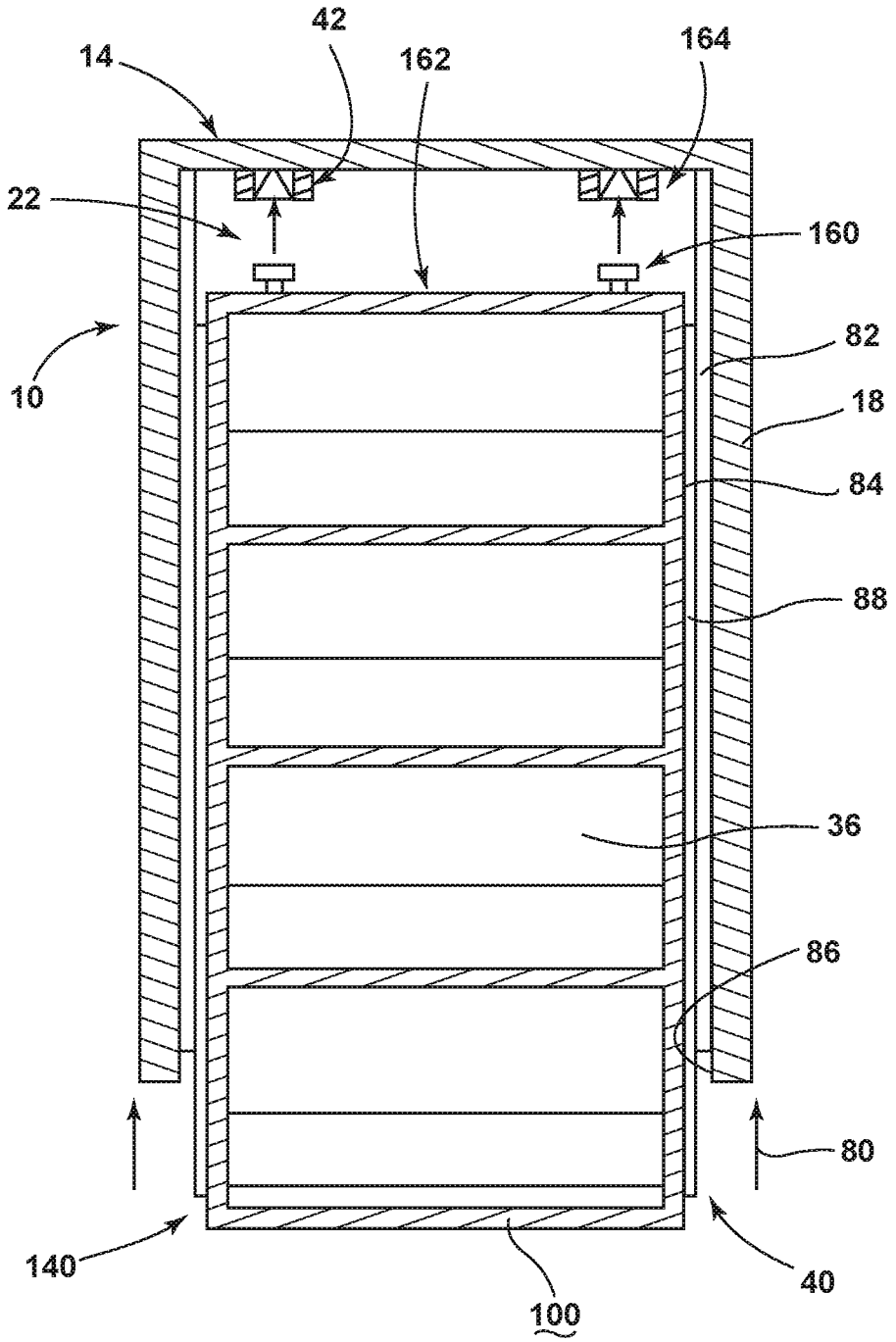
FIG. 9 is a cross-sectional view of a top cabinet incorporating an aspect of the multi-cassette storage module having a push-push retaining mechanism.
Figure 10:
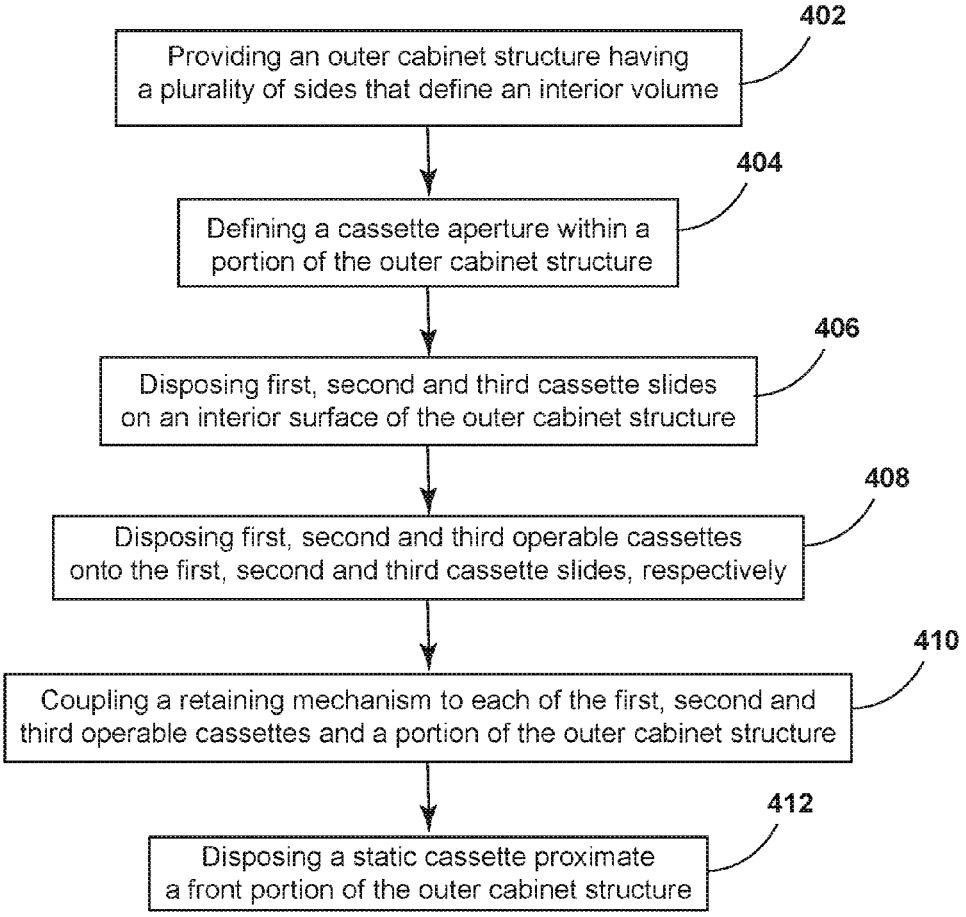
FIG. 10 is a schematic flow diagram illustrating a method for installing a multi-cassette storage module within a cabinet structure.

Referring now to FIGS. 7-9, it is contemplated that the foremost position 70 of the interior volume 22 of the outer cabinet structure 16 can include a front operable panel 20 that provides access through a front aperture 150 of the outer cabinet structure 16. The front operable panel 20 can include a cabinet door that may be rotational, slidable or otherwise operable to access the interior volume 22. In such an embodiment, the outer cabinet structure 16 can include a static cassette 152 disposed within the front portion of the interior volume 22, where the static cassette 152 is fixedly engaged and free of movement within the interior volume 22. It is contemplated that the static cassette 152 can be a thinner profile storage unit that is accessible through the front operable panel 20 when in an open position. The various operable cassettes 30 of the multi-cassette storage module 10 can be disposed behind the static cassette 152 where each of the operable cassettes 30 is positioned in a configuration parallel or substantially parallel with the static cassette 152 and is each independently and selectively vertically operable through the bottom aperture 44 and within the respective vertical plane 38 to define storage and access positions 34. According to the various embodiments incorporating the static cassette 152, the static cassette 152 is fixed to the outer cabinet structure 16 and is not permitted to move. The operable cassettes 30 of the multi-cassette storage module 10 are concealed behind the static cassette 152 when in the storage position 32. As with previously described embodiments, each of the operable cassettes 30 is independently and selectively operable from the storage position 32 to the access position 34 within an access area 40 below the upper cabinet structure 16. Typically, the embodiment incorporating the static cassette 152 will be disposed in an upper cabinet structure 16 incorporating a front operable panel 20 where accessing the static cassette 152 is practical.

Referring again to FIGS. 1-9, the operable cabinet storage unit 14 incorporating a multi-cassette storage module 10 can include the outer cabinet structure 16 having a plurality of sides 18 and a bottom aperture 44 for selectively accessing the interior volume 22 of the cabinet structure 16. The particular outer cabinet structure 16 may or may not include a front operable panel 20, depending upon the position of the outer cabinet structure 16 among the other cabinetry 12 disposed within the cabinet setting. As discussed above, a back corner location 72 between adjacent pieces of upper cabinetry 12 may be fully concealed between the two other pieces of cabinetry 12 such that the only aperture may be the bottom aperture 44 within the bottom wall 46 of the outer cabinet structure 16. It is contemplated that the first, second and third operable cassettes 60, 62, 64, as well as other operable cassettes 30, are selectively and independently positioned within the interior volume 22. Each of the first, second and third operable cassettes 60, 62, 64 are adapted to be linearly operable between the storage position 32 within the interior volume 22 and the access position 34 outside of the interior volume 22. The access position 34 can be defined by any one of the operable cassettes 30 being only partially or fully outside of the interior volume 22. As discussed above, the multi-cassette storage module 10 may include the first, second and third operable cassettes 60, 62, 64 and may also include additional operable cassettes 30 depending upon the size of the cabinetry 12, thickness of each of the operable cassettes 30 and other dimensional considerations. The retaining mechanism 42 for each of the operable cassettes 30 is adapted to extend from each of the first, second and third operable cassettes 60, 62, 64 to the outer cabinet structure 16. It is contemplated that each retaining mechanism 42 selectively and independently retains the corresponding operable cassette 30 within the storage position 32.

Referring now to FIG. 9, it is contemplated that the retaining mechanism 42 can include an operable clip 160 positioned proximate a top area 162 of each of the first, second and third operable cassettes 60, 62, 64 and other operable cassettes 30 that may be disposed within the multi-cassette storage module 10. In such an embodiment, the retaining mechanism 42 can include a push-push retaining mechanism 164 that alternatively retains the corresponding operable cassette 30 of the first, second and third operable cassettes 60, 62, 64 in the storage position 32. The push-push retaining mechanism 164 alternatively releases the corresponding operable cassette 30 from the storage position 32 through the use of a subsequent upward pushing motion exerted by the user.

Referring again to FIGS. 6-9, it is contemplated that each of the first, second and third operable cassettes 60, 62, 64 are vertically operable between the storage and access positions 32, 34 along the respective cassette slides 82. It is further contemplated that each of the first, second and third operable cassettes 60, 62, 64 includes a plurality of subcompartments 36. Each of the plurality of subcompartments 36 of the first, second and third operable cassettes 60, 62, 64 can be accessed when any one or more of the first, second and third operable cassettes 60, 62, 64 occupies and operates within respective first, second and third vertical planes 170, 172, 174 that are parallel with one another. The first, second and third vertical planes 170, 172, 174 are also separate from one another such that each of the first, second and third operable cassettes 60, 62, 64 can be independently and separably operated between the storage and access positions 32, 34.

It is contemplated that each of the operable cassettes 30 can be manually operated between the storage and access positions 32, 34 through use of the cassette slides 82 and/or cassette glides 88 that define a slidable engagement between each of the operable cassettes 30 in the outer cabinet structure 16. It is also contemplated that various other operating mechanisms can be used to assist the user in operating each of the operable cassettes 30 between the storage and access positions 32, 34. Such operating mechanisms can include, but are not limited to, motors, hydraulic mechanisms, pneumatic mechanisms, springs, linearly biasing mechanisms 112, rotational biasing mechanisms 112, counterweights, detents 142, combinations thereof and other similar operating mechanisms that allow for the user to manipulate each of the operable cassettes 30 between the storage and access positions 32, 34.

Having described various aspects of the operable cabinet storage unit 14 incorporating various aspects of the multi-cassette storage module 10, a method 400 is disclosed for installing the multi-cassette storage module 10 within the cabinet structure 16. The method 400 can include a step 402 of providing an outer cabinet structure 16 having a plurality of sides 18 and a bottom aperture 44 for selectively accessing an interior volume 22 of the outer cabinet structure 16. As discussed above, the aperture can include, at least, a bottom aperture 44 defined within the bottom wall 46 of the outer cabinet structure 16 through which each of the operable cassettes 30 can be operated to define the storage and access positions 32, 34. According to various embodiments, the aperture may also include a front aperture 150 that is operable through the use of a front operable panel 20, similar to a conventional upper cabinet. According to the method 400, at least one cassette aperture is defined within a portion of the outer cabinet structure 16 (step 404). As discussed above, the aperture can be at least a bottom aperture 44 and may include a front aperture 150 as well. First, second and third cassette slides 180, 182, 184 can be disposed on an interior surface 86 of the outer cabinet structure 16 (step 406). It is contemplated that cassette slides 82 may also be attached to the at least one edge 84 or both outer edges 84 of the operable cassette 30 to fit within corresponding cassette slides 82. Once the cassette slides 82 are disposed, first, second and third operable cassettes 60, 62, 64 are slidably disposed into first, second and third cassette slides 180, 182, 184, respectively (step 408). It is contemplated that each of the first, second and third operable cassettes 60, 62, 64 are linearly, selectively and separately operable, along the respective first, second and third cassette slides 180, 182, 184 between respective storage positions 32 within the interior volume 22 and respective access positions 34 substantially outside of the interior volume 22. As discussed above, each of the first, second and third operable cassettes 60, 62, 64 are operable within respective first, second and third vertical planes 170, 172, 174 that are separate and parallel to one another. Additionally, the multi-cassette storage module 10 may include a fourth operable cassette 66, fifth operable cassette or more operable cassettes 30 depending upon the size of the outer cabinet structure 16 and/or the thickness of each of the operable cassettes 30. A retaining mechanism 42 is coupled to each of the first, second and third operable cassettes 60, 62, 64, as well as a portion of the outer cabinet structure 16 (step 410). It is also contemplated that the retaining mechanism 42 can be attached to one of the cassette slides 82 that are coupled to the outer cabinet structure 16. It is contemplated that the various retaining mechanisms 42 serve to selectively and separately retain the first, second and third operable cassettes 60, 62, 64 within the storage position 32 and also serve to release the first, second and third operable cassettes 60, 62, 64 from the storage position 32 to be moved to one of the partial access positions 140 or the fully descended access position 34. According to various embodiments, the method 400 may include a step 412 of disposing a static cassette 152 proximate the front operable panel 20, wherein subcompartments 36 of the first, second and third operable cassettes 60, 62, 64 are hidden from view by the static cassette 152 when the first, second and third operable cassettes 60, 62, 64 are in the storage position 32. As discussed above, the use of the static cassette 152 may be incorporated where the upper cabinet of the exposed front surface to which a front operable panel 20 can be attached for moving between open and closed positions to access and conceal the various subcompartments 36 of the static cassette 152.

According to the various embodiments, the parallel planes that the first, second and third operable cassettes 60, 62, 64 operate through can be disposed at an angle such that each operable cassette 30 may be moved downward and forward through the aperture. Such a configuration can provide better accessibility to the various subcompartments 36.

According to the various embodiments, it is contemplated that the multi-cassette storage module 10 can be made of various materials that can include, but are not limited to, metals, woods, composite materials, plastics, combinations thereof, and other similar materials. For aesthetic purposes, a user may desire that each of the operable cassettes 30 be made of the same material as the outer cabinet structure 16 such that the outer cabinet structure 16 of each of the operable cassettes 30 are made of a wooden-type material or a wooden-looking material. It is contemplated that certain users may desire a more contemporary aesthetic such that metals, plastics, glass, ceramics, composite materials, combinations thereof, and other similar materials may be used for the outer cabinet structure 16, one or more of the operable cassettes 30, or other various components of the multi-cassette storage module 10. It is also contemplated that each of the operable cassettes 30 within the multi-cassette storage module 10 may be sized differently for accommodating different types of stored goods. One operable cassette 30 may be dedicated to spices that are substantially small in size, other operable cassettes 30 may be larger for accommodating condiments, oils, and other fluids, and other cassettes may be dedicated for storing utensils, measuring cups, and other similar kitchen-type tools.

According to the various embodiments, the multi-cassette storage module 10 can be incorporated within residential or commercial settings to be disposed within cabinetry 12 located within such settings. Each of the storage cassettes can span a single cabinet 12, or can extend across multiple cabinets 12. Additionally, the multi-cassette storage module 10 can be included within new cabinetry 12, or can be used to retrofit or remodel existing cabinetry 12 to include the multi-cassette storage module 10.

According to the various embodiments, it is contemplated that each of the operable cassettes 30 can be linearly operated between the storage and access positions 32, 34 to a dedicated cassette bottom aperture 44. The use of a dedicated cassette bottom aperture 44 can allow for very minimal dimensional tolerances between an outer edge 84 of each of the operable cassettes 30 and the bottom wall 46 of the outer cabinet structure 16. Such minimal dimensional tolerances can be useful in substantially concealing the presence of the multi-cassette storage module 10, when in the storage position 32. It is contemplated that where a single cassette aperture is disposed in a bottom wall 46 of the outer cabinet structure 16, each of the cassette modules can be positioned substantially close to one another, such that minimal dimensional tolerances can be achieved through the use of a single cassette bottom aperture 44. Such dimensional tolerances for spaces existing between the operable cassettes 30 can vary depending upon each application. Such tolerances can be within a range of approximately 0.5 mm to approximately 1 cm.

According to the various embodiments, each of the subcompartments 36 can include various rails, guides, walls 24, or other securing mechanisms that can serve to obtain various items within each of the subcompartments 36 during operation of the operable cassettes 30 between the storage and access positions 32, 34. Such blocking members can be made of various materials that can include, but are not limited to, metal, wire, wood, glass, ceramic, combinations thereof and other similar materials.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An operable cabinet storage unit comprising:

an outer cabinet structure having a plurality of sides and a bottom aperture for selectively accessing an interior volume;

a plurality of operable cassettes that are each linearly operable through the bottom aperture to define a storage position within the interior volume and an access position outside of the interior volume, wherein each cassette of the plurality of operable cassettes includes a plurality of storage receptacles, wherein each cassette of the plurality of operable cassettes occupies a corresponding vertical plane within the interior volume; and a retaining mechanism that extends from each cassette to the outer cabinet structure, wherein the retaining mechanism selectively retains a corresponding cassette in the storage position; wherein, each cassette is selectively, separately and linearly operable through the respective vertical plane between the storage and access positions;

a front portion of the interior volume includes a front aperture having a front operable panel, wherein a static cassette is disposed proximate the front aperture;

the static cassette is free of movement, and each cassette of the plurality of operable cassettes is positioned parallel with the static cassette; and the static cassette is accessible only through the front aperture when the front operable panel is in an open position.

2. The operable cabinet storage unit of claim 1, wherein each operable cassette of the plurality of operable cassettes is linearly operable in a vertical direction along corresponding cassette slides.

3. The operable cabinet storage unit of claim 1, wherein the retaining mechanism is positioned at a bottom surface of each operable cassette.

4. The operable cabinet storage unit of claim 1, wherein the retaining mechanism includes an outwardly biased pin that selectively extends away from the respective operable cassette to a corresponding retaining slot defined proximate the outer cabinet structure.

5. The operable cabinet storage unit of claim 4, wherein the corresponding retaining slot is defined within a corresponding cassette slide.

6. An operable cabinet storage unit comprising:

an outer cabinet structure having a plurality of sides and a front operable panel for selectively accessing an interior volume;

first, second and third operable cassettes that are selectively and independently positioned within the interior volume, each of the first, second and third operable cassettes being linearly and vertically operable between a storage position within the interior volume and an access position outside of and below the interior volume;

a retaining mechanism that extends from each of the first, second and third operable cassettes to the outer cabinet structure, wherein each retaining mechanism selectively retains a corresponding cassette in the storage position; and a static cassette positioned proximate the front operable panel; wherein, the static cassette is directly and fixedly attached to the outer cabinet structure such that the static structure is free of movement; and receptacles of the first, second and third operable cassettes are inaccessible via the front operable panel.

7. The operable cabinet storage unit of claim 6, wherein the retaining mechanism includes an operable clip positioned proximate a top area of each of the first, second and third operable cassettes.

8. The operable cabinet storage unit of claim 7, wherein the retaining mechanism includes a push-push retaining mechanism that alternatively retains the corresponding cassette of the first, second and third operable cassettes in the storage position and releases the corresponding cassette from the storage position.

9. The operable cabinet storage unit of claim 6, wherein the first, second and third operable cassettes are arranged in a parallel configuration with the static cassette.

10. The operable cabinet storage unit of claim 6, wherein each of the first, second and third operable cassettes occupies and operates within respective first, second and third vertical planes, the first, second and third vertical planes being separate and parallel with one another.

11. The operable cabinet storage unit of claim 6, wherein each of the first, second and third operable cassettes are vertically operable between the storage and access positions along respective cassette slides.

12. The operable cabinet storage unit of claim 6, wherein each of the first, second and third operable cassettes includes a plurality of subcompartments.

13. The operable cabinet storage unit of claim 6, wherein each of the first, second and third operable cassettes are retained within the interior volume when in the storage position.

14. A method for installing a multi-cassette storage unit within a cabinet structure, the method comprising steps of:

providing two intersecting cabinets having rear panels that define an interior volume of a corner-type cabinet structure;

defining at least one cassette aperture within a bottom portion of the cabinet structure, wherein the interior volume is vertically accessible only through the at least one cassette aperture;

disposing first, second and third cassette slides on an interior surface of the cabinet structure;

slidably disposing first, second and third operable cassettes onto the first, second and third cassette slides, respectively, wherein each of the first, second and third operable cassettes are linearly, selectively and separately operable along the respective first, second and third cassette slides through the at least one cassette aperture and between respective storage positions within the interior volume and respective access positions substantially outside of the interior volume, wherein the first, second and third operable cassettes are positioned to vertically operate through the at least one cassette aperture in the bottom wall of the cabinet structure; and coupling a retaining mechanism to each of the first, second and third operable cassettes and a portion of the cabinet structure, wherein the retaining mechanisms selectively and separately retain the first, second and third operable cassettes within the storage position and alternatively releases the first, second and third operable cassette from the storage position.

15. The method of claim 14, wherein each of the first, second and third operable cassettes includes a plurality of subcompartments.

* * * * *